US005791001A

United States Patent [19]

Wang

[11] Patent Number: 5,791,001

[45] Date of Patent: Aug. 11, 1998

[54] MULTI-STAGE ADJUSTABLE DOUBLE-PERSON SPRING BED MATTRESS STRUCTURE

[76] Inventor: Shu-Yuan Wang, No.109, Cheng-Kung Rd., San-Chung City, Taiwan

[21] Appl. No.: 710,420

[22] Filed: Sep. 17, 1996

[51] Int. Cl.[6] ..... A61G 7/00

[52] U.S. Cl. ..... 5/716; 5/722; 5/942; 5/613

[58] Field of Search ..... 5/716, 722, 942, 5/613

[56] References Cited

U.S. PATENT DOCUMENTS

| | | | |
|---|---|---|---|
| 2,651,056 | 9/1953 | Billet et al. | 5/617 |
| 2,702,909 | 3/1955 | Atkins | 5/617 |
| 3,646,621 | 3/1972 | Fragas | 5/617 |

*Primary Examiner*—Brian K. Green
*Assistant Examiner*—Fredrick Carley
*Attorney, Agent, or Firm*—Browdy and Neimark

[57] ABSTRACT

A multi-stage adjustable double-person spring bed mattress structure including a bed tail pad, a fixed bed head pad, a bed face and a bed cover. Two pairs of U-shaped supporting frames are respectively oppositely passed through the clearances between the adjacent longitudinal springs under the metal rods near two lateral sides and the central portion. Two rotating devices are respectively disposed on opposite inner sides of rear ends of the connecting rods under the four U-shaped supporting frames. Two driving splines are passed through the central holes of the above members. When the driving spline is rotated by a rotary disk disposed on one side of the fixed bed pad and having an eccentrical handle, whereby the rotating tube is rotated and inclinedly moved up and down. An insertion seat having an insertion hole is connected on the center of the upper portion of the movable bed head pad, whereby two insertion legs of the pillow racks can be inserted in. By means of the rotary disk on outer side of the driving spline, the rotating device is rotated to drive the movable bed head pad to freely ascend or descend by any angle for lying horizontally or by other resting angle, the pillow can be two-stage 90 degrees rotated to lean on the movable bed head pad as a pillow or outward rotate and stretch into a pillow.

9 Claims, 7 Drawing Sheets

MULTI-STAGE ADJUSTABLE DOUBLE-PERSON SPRING BED MATTRESS STRUCTURE

BACKGROUND OF THE INVENTION

The present invention relates to a multi-stage adjustable double-person spring bed mattress structure including a bed tail pad, a fixed bed head pad, a bed face and a bed cover. By means of a rotating device, the movable bed head pad of the mattress structure can be ascended or descended by any angle for lying horizontally or by other resting angle.

A conventional movable bed mattress can be manually operated to be folded upward through a certain angle. Such operation is quite troublesome. In addition, the movable bed mattress lacks a pillow for a user's head to lean on in a horizontal state or an inclined state. Moreover, the interior of the spring bed mattress is entirely disposed with springs for supporting the pressure from the human body. The springs suffering the weight of the user are subject to depression and the adjacent springs cannot share the pressure.

SUMMARY OF THE INVENTION

It is therefore a primary object of the present invention to provide a multi-stage adjustable double-person spring bed mattress structure in which many longitudinal and transverse metal rods are intersectedly welded on the upper and lower surfaces of the layer of springs, whereby when the bed mattress subjected to a heavy weight, the pressure will be evenly distributed to the lower and adjacent springs, making the user evenly resiliently and comfortably supported by the springs.

It is a further object of the present invention to provide the above bed mattress structure with means of a rotary disk on outer side of the driving spline. A rotating device is rotated by the rotary disk to drive the movable bed head pad to freely ascend or descend by any angle for lying horizontally or by other resting angle. The pillow can be two-stage 90 degrees rotated to lean on the movable bed head pad as a pillow or outward rotate and stretch into a pillow. The driving spline can be electrically controlled by an electrical switch on one side of the bed tail pad by means of a clutch connected with a reducing motor. When the clutch is not operated, the rotary disk can be manually operated.

It is still a further object of the present invention to provide the above bed mattress in which the pillow can be two-stage 90 degrees rotated and leaned on the movable bed head pad, serving as a pillow in a horizontally lying state. The pillow can be alternatively two-stage 90 degrees rotated outward into a pillow. The movable bed head pad can be folded upward to serve as a back for the head to lean on.

It is a further object of the present invention to provide the above bed mattress with a bed cover composed of a high density knitted cotton sandwiched between an upper and a lower fabric sheets. The central portion of upper section of the bed cover is formed with a longitudinal fissure. A metal rod is wrapped by a fabric strip and then stitched with each side to form an opening. The opening is further stitched with each side and two sides of the fissure to form the bed cover with a metal side frame. The metal side frame is further associated with the upper metal side frame of the bed tail pad and two movable bed head pads by a certain distance to form the rigid bed cover.

It is a further object of the present invention to provide the above bed mattress with a bed tail sheet of the bed sheet which is an integral unit. A downward extending shade body is stitched with the bed tail side. The three lateral sides of the shade body is stitched with crimped skirts. The bed head section is divided into two bed head sheets along central line. The head end of the bed head sheet is also stitched with a downward extending shade body. The shade body extends from the lateral side to the center and the shade body extends to the central adjoining portion. Tying cords are disposed on two sides to pull toward the center of the upper portion of the bed face so as to tie up the bed sheet. The bed tail pad and the two movable bed head pads and two pillows are fitted with the shade bodies and firmly tied up by the tying cord around the bed face.

The present invention can be best understood through the following description and accompanying drawings, wherein:

DETAILED DESCRIPTION OF THE PREFERRED EMBODIMENT

Figures 1, 1A:
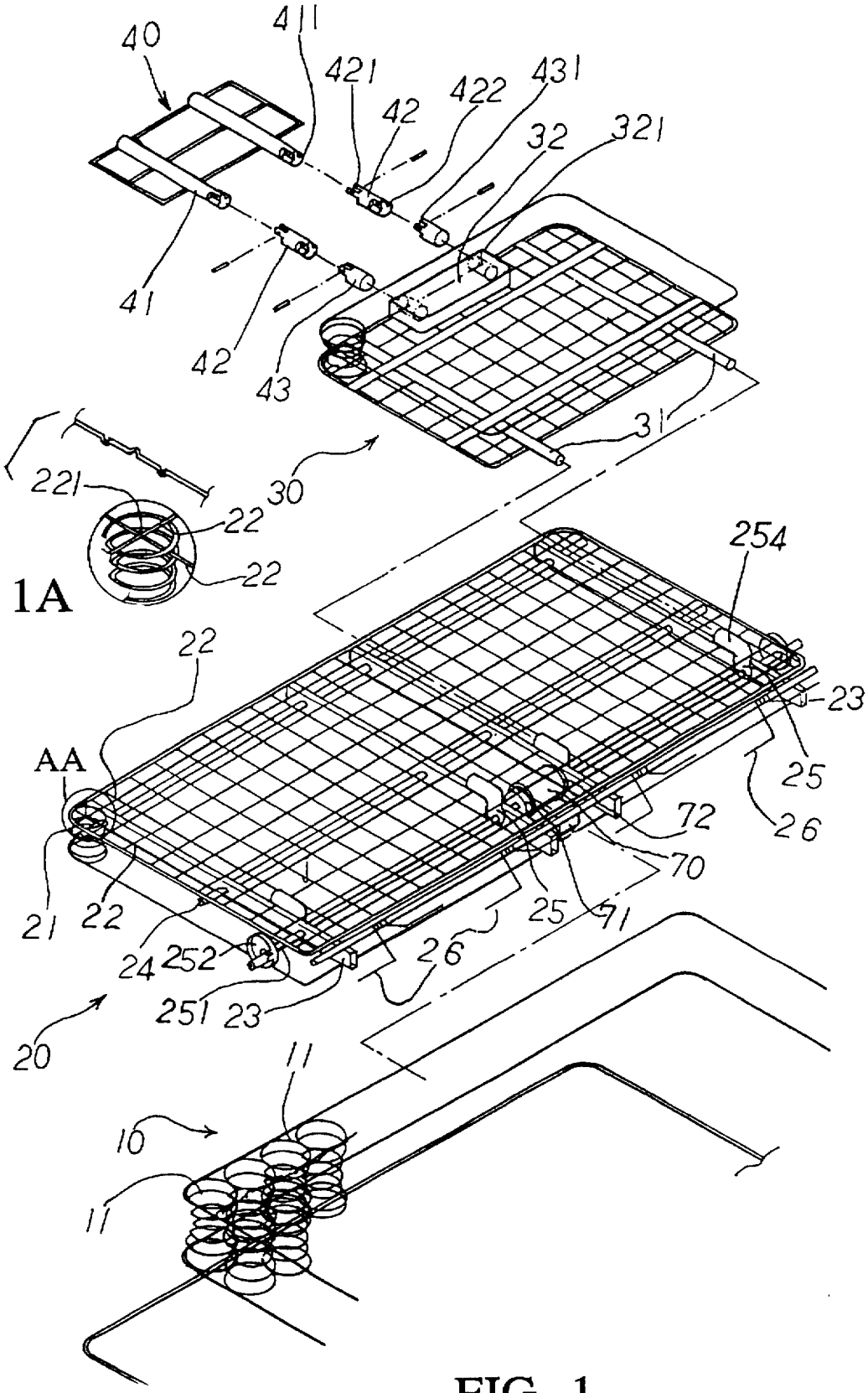
FIG. 1 is a perspective exploded view of the present invention.

Please refer to FIG. 1. The present invention includes a bed tail pad 10, a fixed bed head pad 20, a bed face 80 and a bed cover 90. The fixed bed head pad 20 has a thickness which is one half of the thickness of the bed tail pad 10. Several intersected longitudinal and transverse metal rods 22 are arranged on the upper surface of all the springs 21 (not entirely shown) of the fixed bed head pad 20 and welded therewith at projecting points as an integral unit, whereby when the metal rods 22 are depressed by heavy weight, the pressure can be evenly distributed over the adjacent springs 21. Therefore, a user's back is evenly resiliently supported by the springs 21 as shown in the enlarged portion of FIG. 1. Two Pairs of U-shaped supporting frames 23 are respectively oppositely passed through the clearances between the adjacent longitudinal springs 21 under the metal rods 22 near two lateral sides and the central portion. The four U-shaped supporting frames 23 are respectively formed with transverse through holes on upper and middle portions, whereby two connecting rods 24 are passed therethrough to connect the same. Each of the upper surfaces of the front portions of the metal rods 22 and the lower portions of the supporting frames 23 is punched with a circular recess. Another connecting rod 24 fitted with four springs and four spring couplers 26 is placed and welded in the circular recess.

Figure 2:
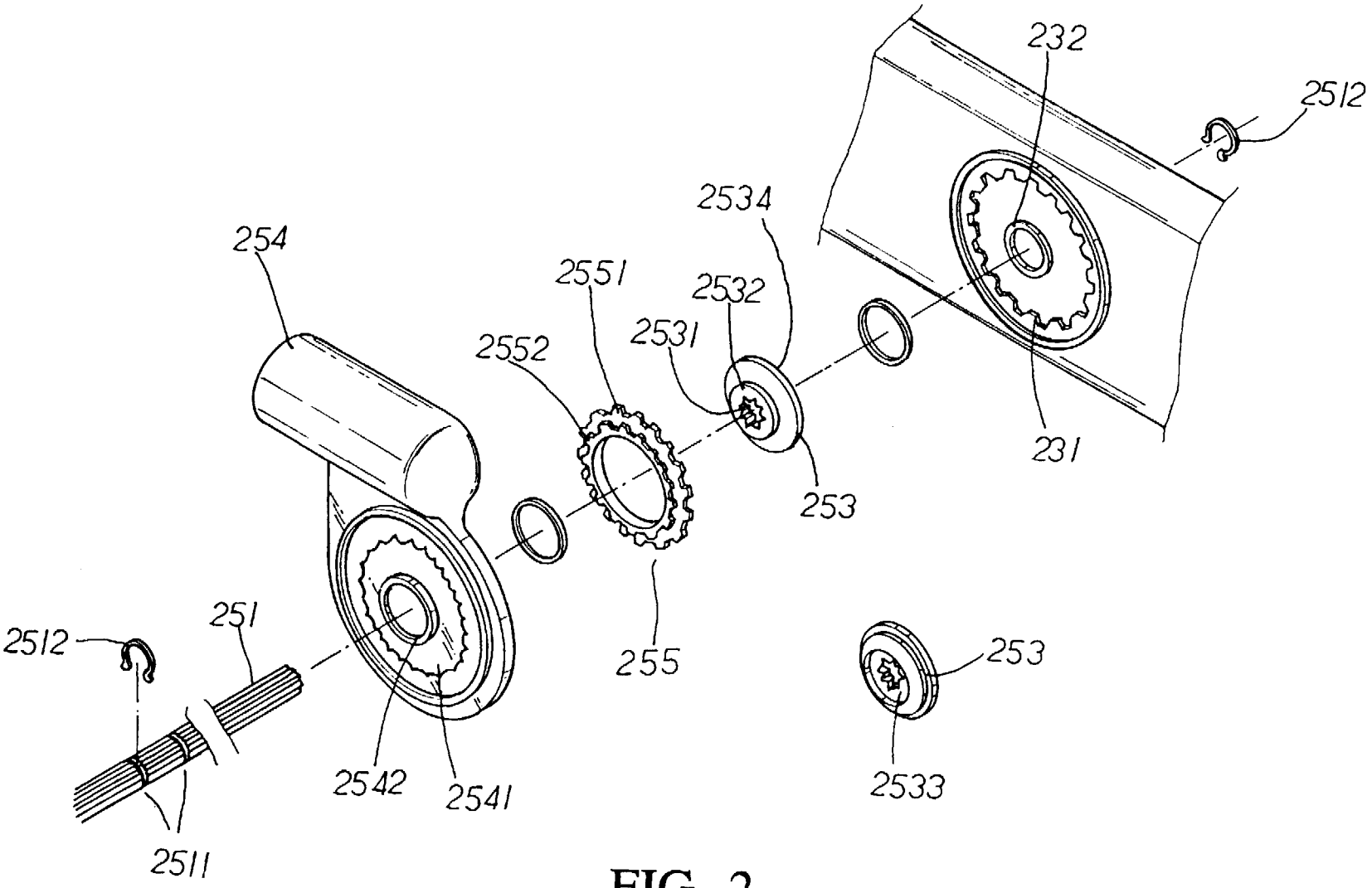
FIG. 2 is a perspective exploded view of the rotating device of the present invention.
Figure 3:
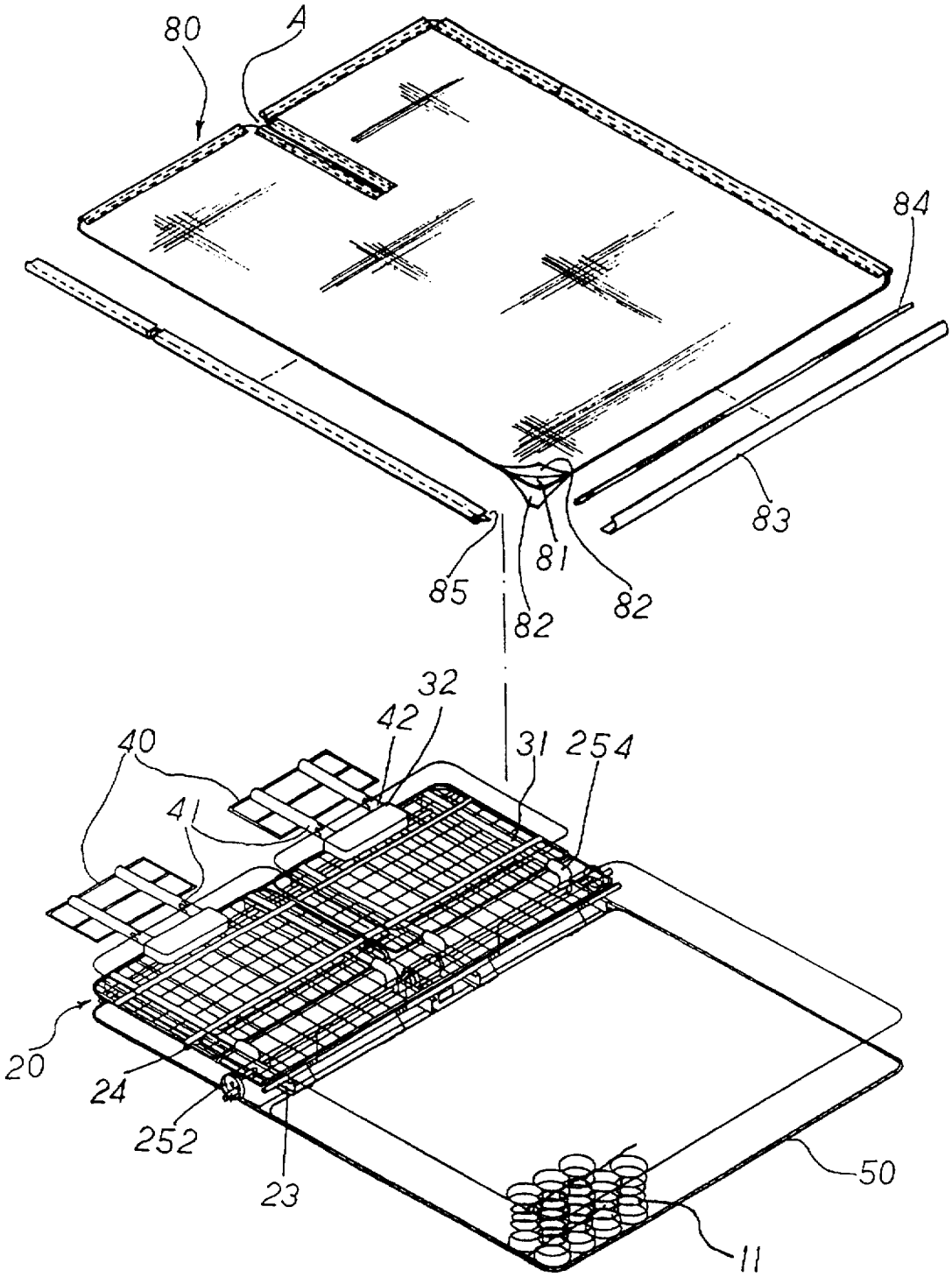
FIG. 3 is a perspective exploded view of the bed cover of the present invention.
Figure 5:
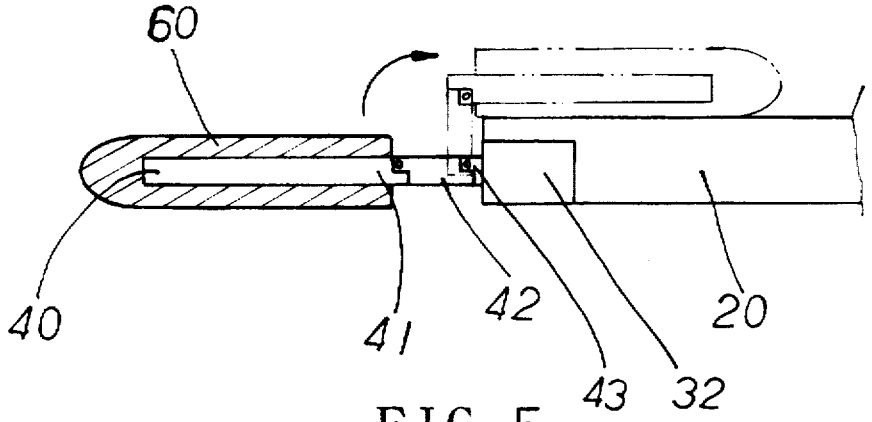
FIG. 5 shows the rotating leg of the pillow rack of the present invention.

Two rotating devices 25 are respectively disposed on opposite inner sides of rear ends of the connecting rods 24 under the four U-shaped supporting frames 23. As shown in FIG. 2, the opposite side of the U-shaped supporting frame 23 is punched with a larger inner edge tooth face 231 and a flange 232 formed with a central through hole which cooperates with a bearing and central toothed through hole 2532 having a flange 2531 on one side and an eccentrical wheel 253 with an annular groove (not shown) on the other side, and a cooperative tooth plate 255 with a large and a small stepped tooth plates 2551, 2552. Another bearing and a recessed toothed face 2541 of the flange 2542 of the base of the rotating tube 254 are fitted with each other. Two driving splines 251 are passed through the central holes of the above members. Each driving spline 251 is disposed with two annular grooves 2511. A C-shaped latch clip 2512 is engaged in the annular groove so as to prevent the assembled rotating device 25 from separating from each other. The area of the recessed toothed face 231 of the supporting frame 23 is larger than that of the larger toothed plate 2551 of the toothed plate 255. The smaller toothed plate 2552 of the toothed plate 255 is snugly engaged with the recessed toothed face of the rotating tube 254. The eccentrical periphery of the eccentrical wheel 253 is placed in the inner edge of the central through hole of the toothed plate 255. When the driving spline 251 is rotated by a rotary disk 252 disposed on one side of the fixed bed pad 20 and having an eccentrical handle, the toothed hole 2532 of the eccentrical wheel 253 is driven, whereby the eccentrical wheel 253 is substantially rotated through an elliptic path along the inner edge of the central through hole of the toothed plate 255 so as to drive the larger toothed plate 2551 of plate 255 to rotate along the toothed path of the recessed toothed face 231 of the supporting frame 23. By means of the engagement between the smaller toothed plate 2552 and the recessed toothed face 2541 of the rotating tube 254, the rotating tube 254 is rotated and inclinedly moved up and down. A reducing motor 70 is disposed under the metal rods 22 between the driving splines 251. Two clutches 71, 72 are disposed respectively on two sides thereof to connect with the driving splines 251 so as to electrically operate the driving splines 251 to rotate. The insertion rods 31 of the movable bed head pad 30 are inserted in the rotating tube 254 of the rotating device 25. The spring coupler 26 of the other connecting rod 24 under the U-shaped supporting frame 23 on the opposite connecting side of the fixed bed head pad 20 and bed tail pad 10 is expanded to clamp the bed tail pad 10 and fixed in the springs 11 so as to associate the fixed bed head pad 20 with the bed tail pad 10 as an integral unit. A bottom frame 50 made of coarse metal rod by bending is fitted around the bottoms of the fixed bed head pad 20 and bed tail pad 10 and an iron string is wound along the bottom frame 50 to assemble the bed head pad 20 and the bed tail pad 10. Referring to FIGS. 1 and 3, an insertion seat 32 having an insertion hole 321 is connected on the center of the upper portion of the movable bed head pad 30, whereby two insertion legs 41 of the pillow racks 40 can be inserted in. The base portion of the insertion legs 41 is disposed with a T-shaped section 411 which is pivotally connected with a rotating leg 42 having a U-shaped projecting section 421 at one end and a substantially T-shaped section 422 at the other end. The T-shaped section 422 of the rotating leg 42 is pivotally connected with a fixing leg 43 having a U-shaped projecting section 431 at one end. The other end of the fixing leg 43 is inserted into the insertion hole 321 of the insertion seat 32 to be two-stage 90 degrees rotated and leaned on the movable bed head pad 30, serving as a pillow as shown in FIG. 5.

Referring to FIG. 3, the bed cover 80 is composed of a high density knitted cotton 81 sandwiched between an upper and a lower fabric sheets 82. The central portion of upper section of the bed cover 80 is formed with a longitudinal fissure A. A metal rod 84 is wrapped by a fabric strip 83 and then stitched with each side to form an opening 85. The opening 85 is further stitched with each side and two sides of the fissure A to form the bed cover 80 with metal side frame. The metal side frame is further associated with the upper metal side frame of the bed tail pad 10 and two movable bed head pads 30 by a certain distance to form the rigid bed cover 80 as shown in FIG. 4.

Figure 4:
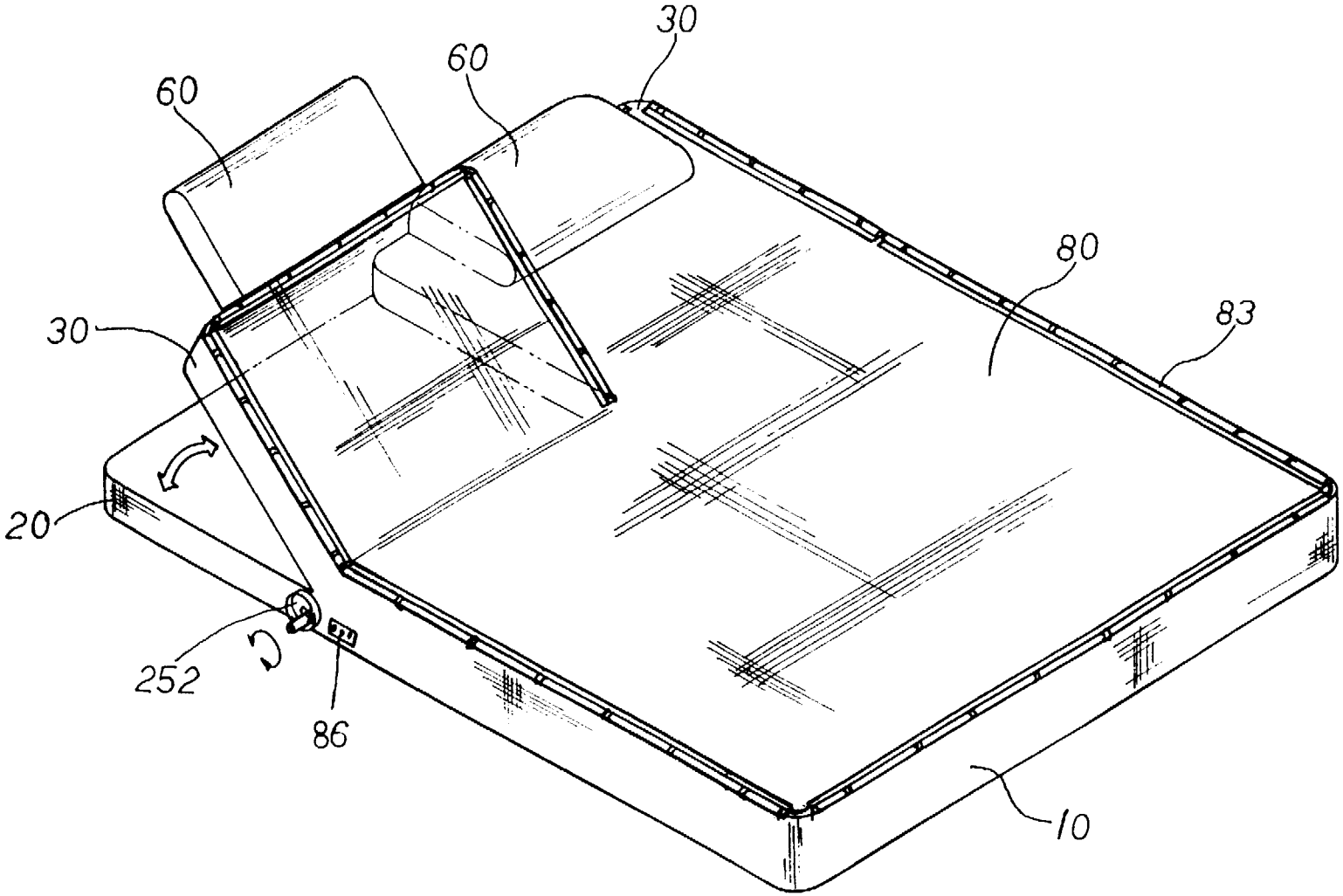
FIG. 4 is a perspective assembled view showing the operation of the present invention.

Referring to FIG. 4, by means of the rotary disk 252 on outer side of the driving spline 251, the rotating device 25 is rotated to drive the movable bed head pad 30 to freely ascend or descend by any angle for lying horizontally or by other resting angle. The pillow 60 can be two-stage 90 degrees rotated to lean on the movable bed head pad 30 as a pillow or outwardly rotated to and stretch into a pillow 60. The driving spline 251 can be electrically controlled by an electrical switch 86 on one side of the bed tail pad 10 by means of clutches 71, 72 connected with the reducing motor 70. When the clutches 71, 72 are not operated, the rotary disk 252 can be manually operated.

Figure 6:
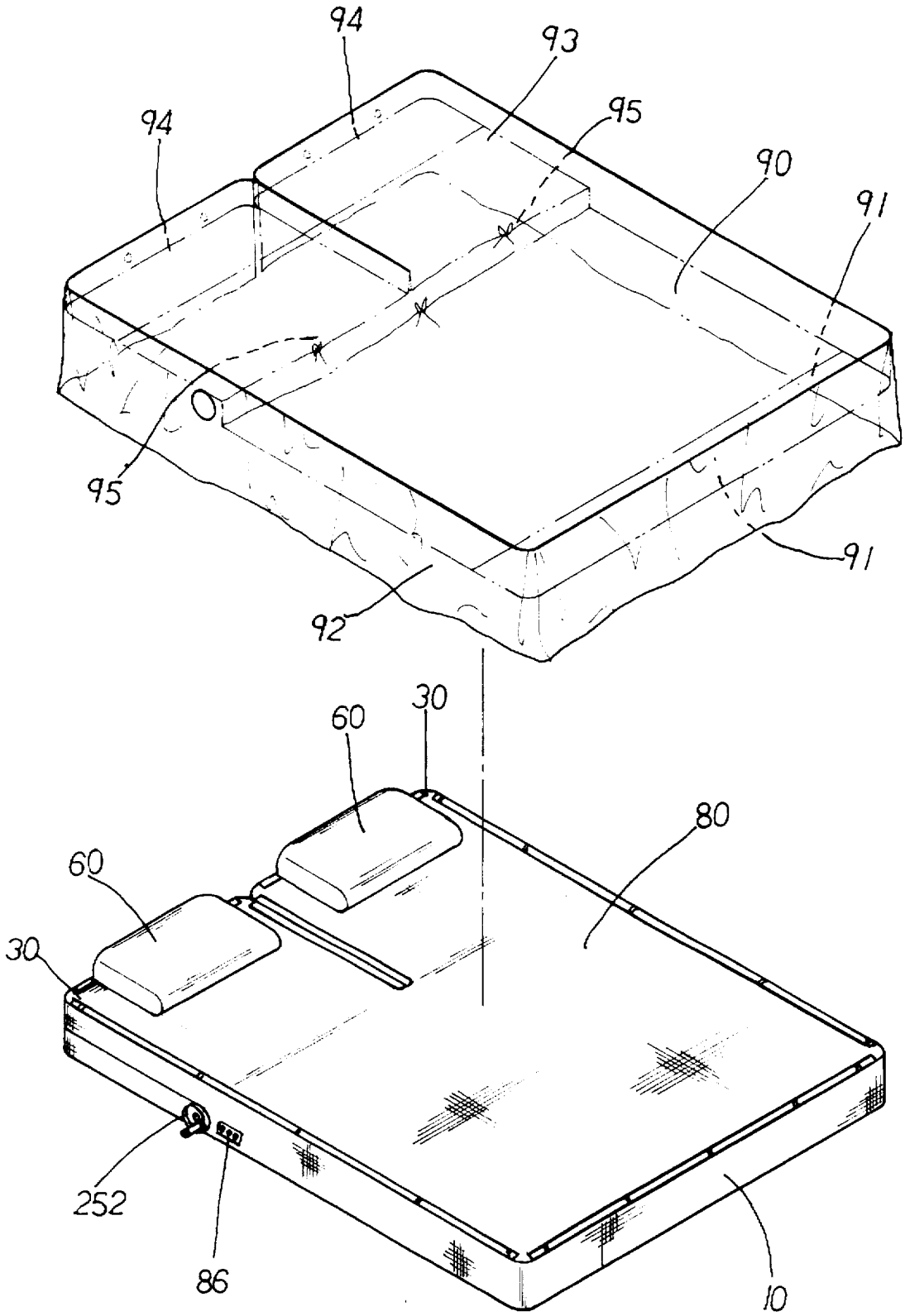
FIG. 6 is a perspective view of the bed sheet of the present invention.
Figure 7:
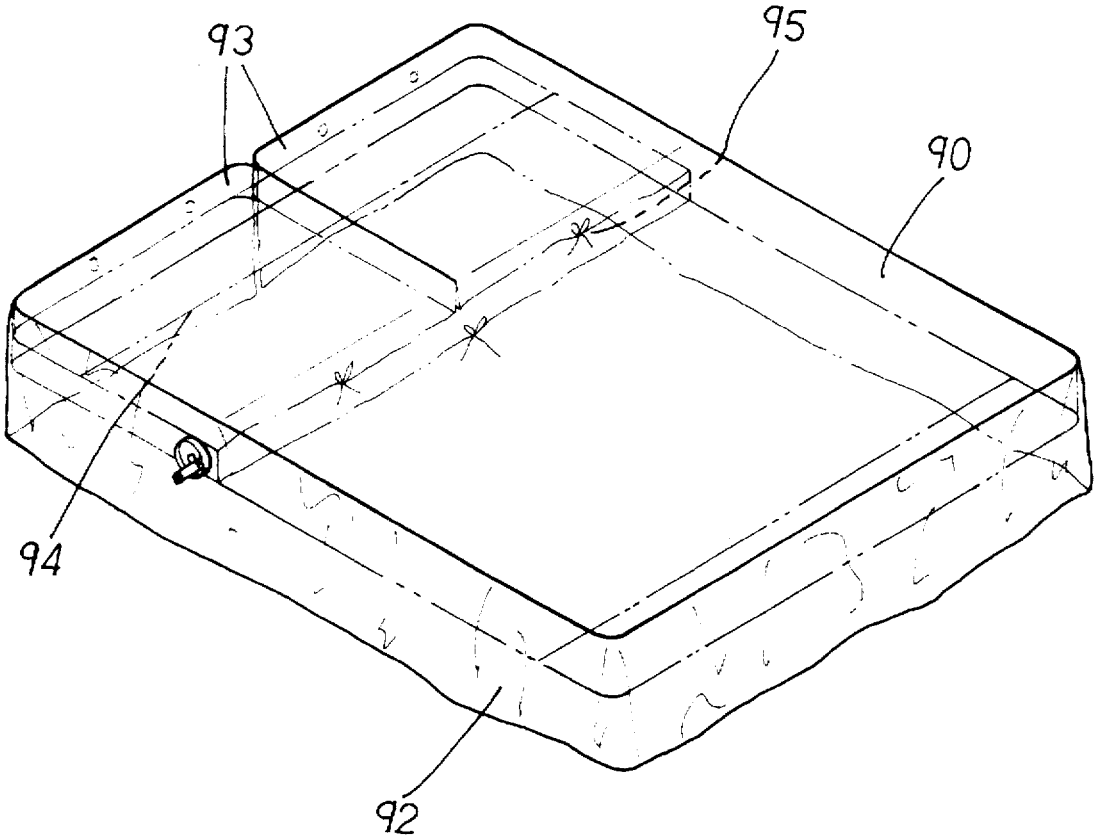
FIG. 7 is a perspective assembled view of the bed sheet and the bed mattress of the present invention.

Please refer to FIGS. 6 and 7. The bed tail sheet of the bed sheet 90 is an integral unit. A downward extending shade body 91 is stitched with the bed tail side. The three lateral sides of the shade body 91 are stitched with crimped skirts 92. The bed head section is divided into two bed head sheets 93 along a central line. The head end of the bed head sheet 93 is also stitched with a downward extending a shade body 94. The shade body 94 extends from the lateral side to the center and the shade body 91 extends to the central adjoining portion. Tying cords 95 are disposed on two sides to pull toward the center of the upper portion of the bed face 80 so as to tie up the bed sheet 90. The bed tail pad 10 and the two movable bed head pads 30 and two pillows 60 are fitted with the shade bodies 91, 94 and firmly tied up by the tying cord 95 around the bed face 80.

The above embodiment is only an example of the present invention and the scope of the present invention should not be limited to the example. Any modification or variation derived from the example should fall within the scope of the present invention.

What is claimed is:

1. An adjustable bed head pad for attachment to an existing spring bed mattress, said bed head pad comprising:

a fixed bed head pad, and a movable bed head pad, said movable bed head pad being rotatably engaged to, and above, said fixed bed head pad around an edge of said movable bed head pad;

said bed head pad having attachment means for securely engaging said bed head pad to springs of said spring bed mattress;

said fixed bed head pad having a plurality of springs;

said fixed bed head pad having a plurality of intersecting rods fixed to an upper surface of said plurality of springs;

a plurality of U-shaped supporting frames located below said intersecting rods and between said plurality of springs engaged to said fixed bed head pad, said plurality of U-shaped supporting frames being connected together by connecting rods below said intersecting rods;

rotating means fixed to said plurality of U-shaped supporting frames and engaged to said movable bed head pad for rotating said movable bed head pad up and down around the edge of said moveable bed;

wherein, said attachment means is adapted to engage said spring bed mattress, said rotating means can be operated to support a head and shoulders of an occupant at an angle to a surface of said spring bed mattress.

2. The adjustable bed head pad, wherein said rotating means can be either manually or electrically operated.

3. The adjustable bed head pad according to claim 1 wherein an insertion seat having insertion holes is connected on a center of an upper portion of the movable bed head pad, two insertion legs of a pillow rack being inserted and engaged in said insertion holes.

4. The adjustable bed head pad, according to claim 3, wherein a base portion of each of the insertion legs has a T-shaped section and is pivotally connected with a rotating leg having a U-shaped projecting section at one end and a substantially T-shaped section at the other end, the T-shaped section of the rotating leg being pivotally connected with a fixing leg having a U-shaped projecting section at one end, the other end of the fixing leg being inserted into an insertion hole of said insertion holes of the insertion seat to permit two-stage 90 degree rotation of the pillow rack on the movable bed head pad.

5. The adjustable bed head pad according to claim 1, wherein a bed cover is provided with said bed head pad for use in combination with the bed head pad and the spring bed mattress when engaged together by said attachment means.

6. The adjustable bed head pad according to claim 5, wherein the bed cover is composed of a high density knitted cotton sandwiched between an upper and a lower fabric sheet, a central portion of an upper section of the bed cover being formed with a longitudinal fissure, metal rods being wrapped by a fabric strip and then stitched with each side of the fissure and each edge of the bed cover to form a metal side frame.

7. The adjustable bed head pad according to claim 6 wherein a bed sheet is provided with said bed head pad for use in combination with the bed head pad and the spring bed mattress when engaged together by said attachment means, wherein said bed sheet has crimped skirts and is divided into two bed head sheets along central line, a head end of each of said bed head sheets being stitched with a downward extending shade body, and tying cords for tying the bed sheet.

8. The adjustable bed head pad according to claim 1, wherein the rotating means comprises two rotating devices disposed on the U-shaped supporting frames, each of a pair of the U-shaped supporting frames being punched with a larger inner edge tooth face and a flange formed with a central through hole which cooperates with each of said rotating devices, each of said rotating devices having a first bearing and central toothed through hole having a flange on one side and an eccentrical wheel with an annular groove on the other side, and a cooperative tooth plate with a large and a small stepped tooth plates, a second bearing and a recessed toothed face of a flange of a base of a rotating tube being fitted with each other, a driving spline respectively passing through each of the rotating devices and said supporting frames, each driving spline being disposed with two annular grooves, a C-shaped latch clip being engaged in the annular groove so as to prevent the assembled rotating means from separating, an area of the recessed toothed face being larger than that of the larger toothed plate of the toothed plate, the smaller toothed plate of the toothed plate being snugly engaged with the recessed toothed face of the rotating tube, the eccentrical periphery of the eccentrical wheel being placed in the inner edge of the central through hole of the toothed plate, wherein when the driving spline is rotated by a rotary disk disposed on one side of the fixed bed pad and having an eccentrical handle, the toothed hole of the eccentrical wheel is driven, whereby the eccentrical wheel is substantially rotated through an elliptic path along the inner edge of the central through hole of the toothed path of the recessed toothed face of the supporting frame, by means of the engagement between the smaller toothed plate and the recessed toothed face of the rotating tube, the rotating tube being rotated along with a movable bed head pad engaged to said rotating tube and inclinedly moved up and down, and a reducing motor being disposed under the metal rods engaged to the driving splines.

9. The adjustable bed head pad according to claim 8, wherein said rotating means further comprises two clutches disposed respectively on two sides of the reducing motor and connected to each driving spline so as to electrically operate the driving splines to rotate, insertion rods of the movable bed head pad being inserted in the rotating tube of the rotating device, and wherein the attachment means has a spring coupler adapted to expand and clamp to the spring bed mattress.

* * * * *